US007896646B2

(12) United States Patent
Flohr et al.

(10) Patent No.: US 7,896,646 B2
(45) Date of Patent: Mar. 1, 2011

(54) PREMIXING BURNER ARRANGEMENT FOR OPERATING A COMBUSTION CHAMBER IN ADDITION TO A METHOD FOR OPERATING A COMBUSTION CHAMBER

(75) Inventors: Peter Flohr, Turgi (CH); Christian Oliver Paschereit, Berlin (DE)

(73) Assignee: Alstom Technology Ltd, Baden (CH)

( * ) Notice: Subject to any disclaimer, the term of this patent is extended or adjusted under 35 U.S.C. 154(b) by 764 days.

(21) Appl. No.: 10/586,816

(22) PCT Filed: Jan. 12, 2005 (Under 37 CFR 1.47)

(86) PCT No.: PCT/EP2005/050105

§ 371 (c)(1), (2), (4) Date: Nov. 26, 2007

(87) PCT Pub. No.: WO2005/068913

PCT Pub. Date: Jul. 28, 2005

(65) Prior Publication Data

US 2008/0227039 A1 Sep. 18, 2008

(30) Foreign Application Priority Data

Jan. 20, 2004 (CH) ..... 0072/04

(51) Int. Cl.
*F23R 3/28* (2006.01)

(52) U.S. Cl. ..... 431/9; 431/350; 431/8; 431/351

(58) Field of Classification Search ..... 431/9, 8, 431/350, 351, 353, 354
See application file for complete search history.

(56) References Cited

U.S. PATENT DOCUMENTS

| | | | | |
|---|---|---|---|---|
| 5,193,346 | A | 3/1993 | Kuwata et al. | |
| 6,102,692 | A * | 8/2000 | Dobbeling et al. | 431/350 |
| 6,186,775 | B1 * | 2/2001 | Jansohn et al. | 431/285 |
| 2003/0074885 | A1 | 4/2003 | Rakke | |
| 2007/0259296 | A1 * | 11/2007 | Knoepfel | 431/9 |

FOREIGN PATENT DOCUMENTS

| | | |
|---|---|---|
| EP | 0 210 462 A1 | 2/1987 |
| EP | 0 321 809 A1 | 6/1989 |
| EP | 0 849 531 A2 | 6/1998 |

* cited by examiner

*Primary Examiner* — Alfred Basichas
(74) *Attorney, Agent, or Firm* — Buchanan Ingersoll & Rooney PC

(57) ABSTRACT

A premixing burner is disclosed for operating a combustion chamber with a liquid and/or gaseous fuel, with a swirl generator for a combustion inflow air stream for forming a swirl flow, and with injection of fuel into the swirl flow. The swirl generator is adjacent to the combustion chamber indirectly via a mixing zone or directly, in each case via a burner outlet, a cross-sectional widening at the burner outlet being provided which, is discontinuous in the flow direction of the swirl flow and through which the swirl flow bursts open so as to form a backflow zone. A contour locally narrowing the flow cross section of the swirl generator or of the mixing zone in the flow direction can be provided upstream of the burner outlet.

17 Claims, 3 Drawing Sheets

PREMIXING BURNER ARRANGEMENT FOR OPERATING A COMBUSTION CHAMBER IN ADDITION TO A METHOD FOR OPERATING A COMBUSTION CHAMBER

RELATED APPLICATIONS

The present application claims priority under 35 U.S.C. §120 as a continuation of PCT/EP2005/050105, filed Jan. 12, 2005, and claims priority under 35 U.S.C. §119 to Swiss Patent Application No. 00072/04, filed Jan. 20, 2004, the disclosures of which are hereby incorporated by reference in their entireties.

BACKGROUND

1. Field

A premixing burner and a method for operating a combustion chamber by means of a liquid and/or gaseous fuel are disclosed, with a swirl generator for a combustion inflow air stream for forming a swirl and with means for the injection of fuel into the swirl flow, the swirl generator being adjacent to the combustion chamber indirectly via a mixing zone or directly, in each case via a burner outlet, a cross-sectional widening at the burner outlet being provided, which is discontinuous in the flow direction of the swirl flow and through which the swirl flow bursts open so as to form a backflow zone.

2. Background Information

Premixing burners are known from a multiplicity of prior publications, such as, for example, EP A1 0 210 462 and EP B1 0 321 809, to name only a few. Premixing burners of this type are based on the general operative principle of generating, within a swirl generator mostly designed conically and providing at least two part-conical shells assembled with a correspondingly mutual overlap, a swirl flow which consists of a fuel/air mixture and which is ignited within a combustion chamber, following the premixing burner in the flow direction, so as to form a premixing flame which is then as stable as possible in spatial terms. In this case, the spatial position of the premixing flame is determined by the aerodynamic behavior of the swirl flow, the swirl coefficient of which increases within an increasing propagation along the burner axis and which consequently becomes unstable and ultimately, due to a discontinuous cross-sectional transition between the burner and combustion chamber, bursts open into an annular swirl flow, so as to form a backflow zone, in the front region of which the premixing flame is formed.

The vortex backflow zone has only limited stability properties, and therefore there have already been a multiplicity of proposals for improving the stability properties of backflow zones of this kind. For as stable a vortex backflow zone as possible, it is essential that the axial profile of the swirl flow generated by the swirl body should have a low swirl in the center, that is to say the region of the burner axis, and, moreover, an axial velocity excess should be present there. These considerations have led to a burner according to EP 0 321 809 B1.

The double cone burner described in this publication is shown in FIG. 2 diagrammatically in the form of a longitudinal sectional illustration and has a conically designed swirl flow generator 1, of which the two part-conical shells placed one in the other in each case enclose two air inlet slits 2. The swirl generator 1 issues at the burner outlet 3 directly into the combustion chamber 4 via a discontinuous cross-sectional widening. By the combustion inflow air being fed in tangentially along the air inlet slits 2, a swirl flow is generated which is propagated in the axial flow direction with an increasing swirl about the axial direction of the swirl generator. On account of the increasing swirl in the axial flow direction, the instability of the swirl flow increases and merges into an annular swirl flow with backflow. A backflow zone 5 is formed essentially within the combustion chamber 4 in the region of the burner outlet 3, with a front located forward in the flow direction or with a forward stagnation point 6, of which the axial position in relation to the premixing burner 1 is to be determined essentially by the cone angle $2\gamma$ and the slit width of the air inlet slits 2. The size and appearance of the backflow zone 5 can be essentially determined by the choice of size of the above geometric values.

Within the backflow zone 5, the premixing flame 7 is formed, which is stabilized at the front region of the inner backflow zone 5.

Investigations into the stability of a flame 7 of this kind have shown that the aerodynamic stability of the inner recirculation or backflow zone 5 has a decisive influence on the position, shape and size of the premixing flame 7.

If the above-described premixing burner serves for the generation of hot gases for driving a gas turbine plant, then, for reasons of the optimization of the efficiency of the gas turbine plant, it is appropriate to keep the pressure loss across the burner as low as possible. Since the swirl coefficient and pressure loss are in direct proportion to one another, it is desirable to have as low a swirl coefficient as possible within the swirl flow, which should be selected so as to be just high enough to ensure that an inner backflow zone is formed.

On the other hand, the aim must be to keep the forward stagnation point 6 of the backflow zone 5 as stable as possible aerodynamically, in order to prevent the situation where, due to a pronounced variation in the flame position, the premixing flame front anchored at the forward stagnation point 6 causes thermoacoustic instabilities which not only have a persistent influence on the efficiency of a gas turbine plant, but, moreover, cause considerable material stresses on almost all the components in the gas turbine plant which are in direct contact with the hot gases, with the result that the overall lifetime of the plant is ultimately reduced. However, the desire for as high an aerodynamic stability as possible in the forward flame front within the backflow zone is in contradiction with the efficiency-induced reduction in the swirl coefficient which leads to lower swirl gradients in the burner, in particular at the location of the forward stagnation point 6. However, a lower swirl gradient implies a greater deflection at the stagnation point in the flow direction, possibly with disturbances occurring, and is conducive to the above-described formation of thermoacoustic instabilities.

SUMMARY

A premixing burner is disclosed wherein, on the one hand, the aerodynamic stability of the inner backflow zone can be increased, particularly in the region of the forward stagnation point, without an appreciable additional burner pressure loss in this case having to be taken into account. Furthermore, a corresponding method for operating a combustion chamber can be disclosed, which is to serve both for avoiding the occurrence of thermoacoustic oscillations and for achieving the aim of as low a burner pressure loss as possible.

An exemplary premixing burner is based on the idea that the aerodynamic stability of the free inner backflow zone can be increased in that the swirl gradient of the swirl flow is increased locally upstream of the forming backflow zone in the flow direction. By the swirl gradient being increased only locally, that is to say along the axially propagating swirl flow within the premixing burner, it is appropriate to raise the swirl coefficient in the axial flow direction from an initial swirl coefficient to a higher swirl coefficient in a spatially limited manner and to lower it immediately thereafter to the initial swirl coefficient or to a swirl coefficient lower than the latter. In an exemplary embodiment, the overall burner pressure loss is increased only insignificantly, thus resulting in no or only very slight effects on the overall efficiency of a gas turbine.

An exemplary premixing burner is distinguished in that a contour locally narrowing the flow cross section of the swirl generator or, if present, of the mixing zone in the flow direction is provided upstream of the burner outlet.

This contour locally narrowing the flow cross section has advantageously a longitudinal section oriented in the flow direction which corresponds comparably to that of a Venturi tube arrangement, that is to say the contour has in the flow direction a first segment which continuously reduces the flow cross section and merges continuously into a second segment with a smallest flow cross section, which has adjoining it in the flow direction a third segment again continuously increased in the flow cross section. By a contour locally narrowing the flow cross section in the flow direction being provided, the swirl flow or burner flow is accelerated in the region of the first segment, on account of the continuous reduction in flow cross section, according to Bernoulli's flow relations and, after passing through the region with the smallest flow cross section, is decelerated correspondingly.

On account of this convergent/divergent flow routing along the burner axis in the flow direction by the contour narrowing the flow cross section, the swirl gradient can be increased locally, as a result of which, in turn, the aerodynamic stability of the forming forward front of the backflow zone can be improved. Because of an unchanged burner contour at the burner outlet, especially since the contour is located upstream of the burner outlet, the burner pressure loss can be influenced only insignificantly. An impairment of the overall efficiency of a gas turbine can thereby be largely avoided.

It is advantageously appropriate to position the contour narrowing the flow cross section along the burner axis within the premixing burner in such a way that the contour is provided in the region of the foremost front, for example, directly upstream of the forming backflow zone in the flow direction.

If the premixing burner is a double cone burner, the swirl generator of which includes (e.g., consists essentially of) two part-conical shells placed one in the other, and, furthermore, no further mixing tube is provided between the double cone burner and the combustion chamber, so that the swirl generator issues with its burner outlet directly into the combustion chamber via a discontinuous cross-sectional widening, then an exemplary measure as disclosed herein, which can on the one hand additionally be added as an additional shape at a suitable axial point along the inner circumferential edge of the two part-conical shells, thus affording the possibility of retrofittability, or which is already incorporated in one piece by forming into the inner side of the two part-conical shells, gives rise an to elliptic cross-sectional shape at the location of the narrowest or smallest flow cross section caused by the contour. An exemplary measure is, of course, also applicable to premixing burner systems, the swirl generators of which are assembled from more than two part-conical shells or in which a mixing tube is provided as an additional mixing zone between the swirl generator and combustion chamber. If mixing tubes are provided, the contour narrowing the flow cross section is to be provided in the inner wall region of the mixing tube, near the burner outlet, at the transition to the combustion chamber.

An exemplary embodiment of the local narrowing of the flow cross section for the purpose of the aerodynamic stabilization of the forming backflow zone within a premixing burner used for example, for operating a combustion chamber which serves for firing a gas turbine plant is based on the process engineering notion of providing at the location of the foremost stagnation point of the backflow zone aerodynamic conditions which prevent an axial creep of the stagnation point. For this purpose, the swirl flow oriented in the axial flow direction can be accelerated, due to the contour-induced nozzle effect, within the premixing burner, for example within the swirl generator, axially upstream of the foremost stagnation point of the backflow zone and is decelerated likewise upstream of the stagnation point of the backflow zone in the flow direction, in such a way that as high a velocity gradient as possible, with a reversal in flow direction, prevails at the axial location of the stagnation point. This may be achieved by means of a convergent and divergent flow routing lying in a focused manner upstream of the location of the stagnation point. Further details may be gathered, furthermore, from the detailed description of the exemplary embodiments.

BRIEF DESCRIPTION OF THE DRAWINGS

The invention is described below by way of example by means of exemplary embodiments, without any restriction to the general idea of the invention, with reference to the drawings in which.

DETAILED DESCRIPTION

Figure 1:
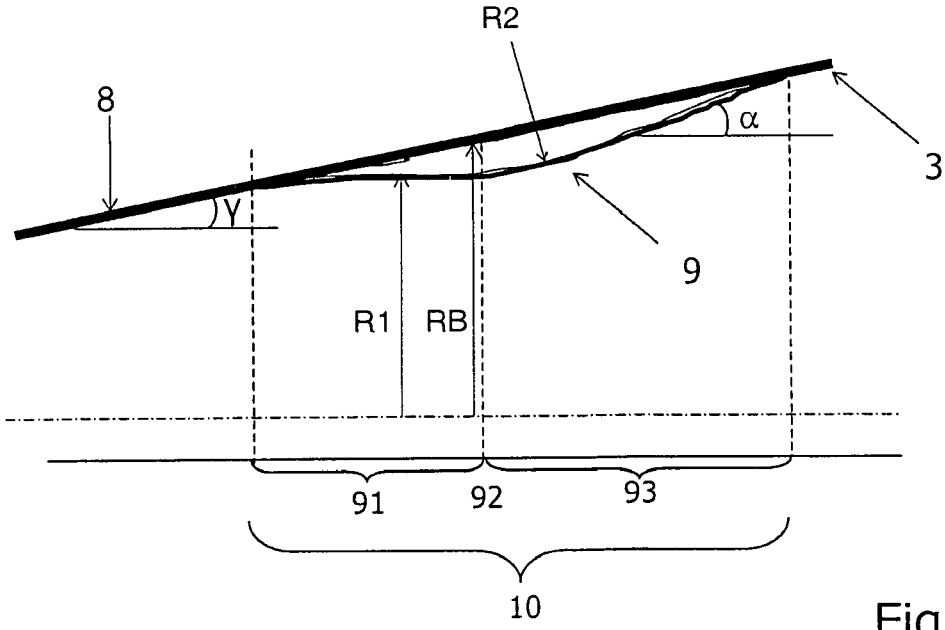
FIG. 1 shows a diagrammatic illustration of a part longitudinal section through an exemplary swirl generator.

FIG. 1 shows a diagrammatic detail of a longitudinal section through a swirl generator of a double cone premixing burner with a burner wall 8 which with the burner axis A forms a cone half angle $\gamma$. A contour 9 narrowing the axial flow cross section is provided on the inside of the burner wall 8 upstream of the burner outlet 3. The contour 9 reduces the flow cross section longitudinally with respect to the burner axis A within a local region 10 in such a way that the shape and size of the burner outlet 3 are not impaired by the contour 9. The contour 9 has a first segment 91, by means of which the flow cross section is reduced continuously. The first segment 91 has adjoining it directly a second segment 92 which predetermines the smallest flow cross section. The second segment 92 is, for example, merely punctiform or linear. The region of the smallest flow cross section has adjoining it downstream a third segment 93 by means of which the flow cross section is widened again, for example, to a dimension which is predetermined by the burner wall 8 on the outlet side.

In the case of a double cone burner, the contour 9 narrowing the flow cross section runs around annularly, largely closed, in the circumferential direction with respect to the two part-conical shells, so that, as a result of the cooperation of the contours 9 formed in each case on the two part-conical shells, a flow segment is produced which corresponds to that of a Venturi tube.

More detailed particulars with regard to design and arrangement of the contour 9 within the premixing burner are derived from theoretical considerations and experimental observations. If it is assumed, with regard to FIG. 1, that the burner axis A is considered in the flow direction as the x-axis, this results in the following exemplary design parameter requirements with respect to the x-axis:

$$0.5 \leqq R1(x)RB(x) \leqq 1$$

$$0.5 \leqq R2(x)RB(x) \leqq 2 \text{ and}$$

$$\gamma < \alpha < 40°$$

with x: locus coordinate along the mid-axis of a part-conical shell

R1: radial distance between the mid-axis of a part-conical shell and the surface of the contour at the locus x along the mid-axis RB: radial distance between the mid-axis of a part-conical shell and the surface of the original part-conical shell at the locus x along the mid-axis R2: elevation of the contour, measured from the surface of the part-conical shell at the locus x along the mid-axis α: angle between a tangential surface of the contour and the mid-axis of the part-conical shell at the locus x along the mid-axis γ: cone half angle.

As regards the terms "burner axis" and mid-axis of the respective part-conical shells, it may be noted that, for reasons of a simplified description, reference is made, with regard to the flow behavior within the swirl generator, only to a burner axis A. On account of the multipart nature of the swirl generator which provides two or more part-conical shells engaging one in the other, however, each individual part-conical shell has a part-cone mid-axis assigned to it, briefly the mid-axis of the respective part-conical shell. Due to the spatial arrangement of the part-conical shells, these corresponding mid-axes do not coincide. For the above design parameter requirements, however, the corresponding mid-axes of the part-conical shells must be emphasized.

Figure 2:
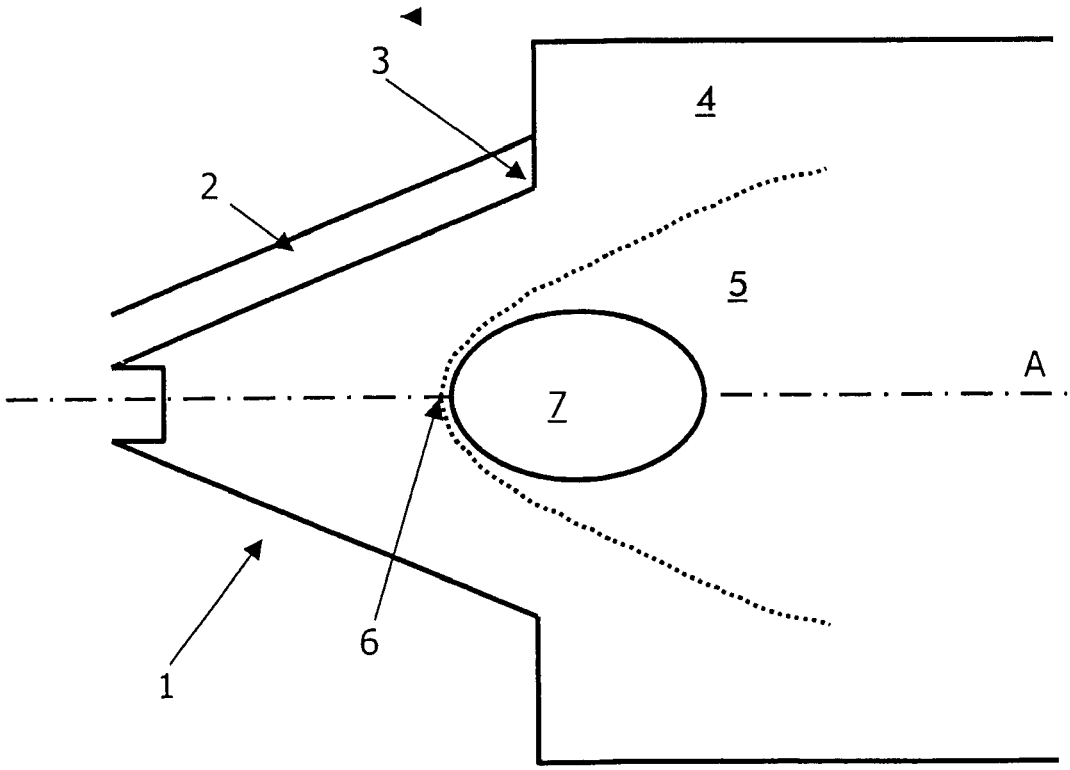
FIG. 2 shows a diagrammatic illustration of a longitudinal section through an exemplary premixing burner with a combustion chamber.

The description of FIG. 2 was already dealt with in detail in the description introduction, and therefore a further description is dispensed with at this juncture.

Figure 3:
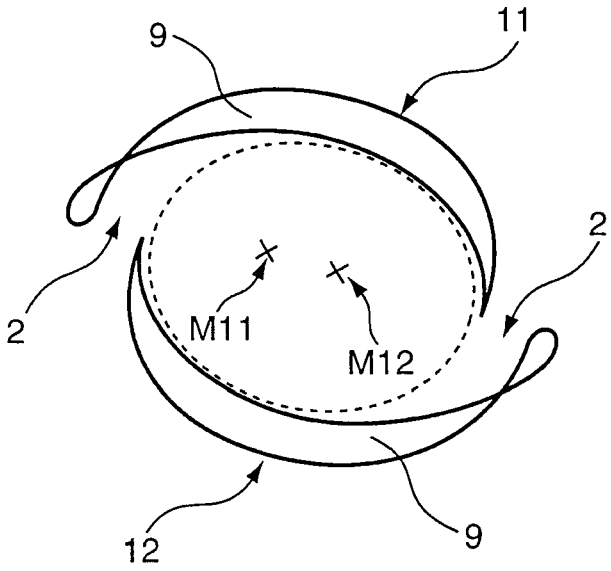
FIG. 3 shows a cross-sectional illustration through an exemplary swirl generator at the location of the smallest flow cross section.

FIG. 3 shows a diagrammatic cross section through a double cone burner in the region of the contour-induced narrowest flow cross section 92. The two part-conical shells 10, 11 have in each case mid-axes M11, M12 belonging to them and are placed one in the other in such a way that they form with one another two opposite air inlet slits 2 running tangentially. Due to the contours 9, the overall flow cross section through the swirl generator is narrowed in the manner of an ellipse shape (dashed line). Such an elliptical flow cross section has advantageously aerodynamically stabilizing effects on the burner behavior over a wide operating range. To avoid impairing the inflow behavior at the air inlet slits 2, the contours 9 are correspondingly thinned in a streamlined manner in these regions, so as ultimately not to reduce the slit width.

Figure 4:
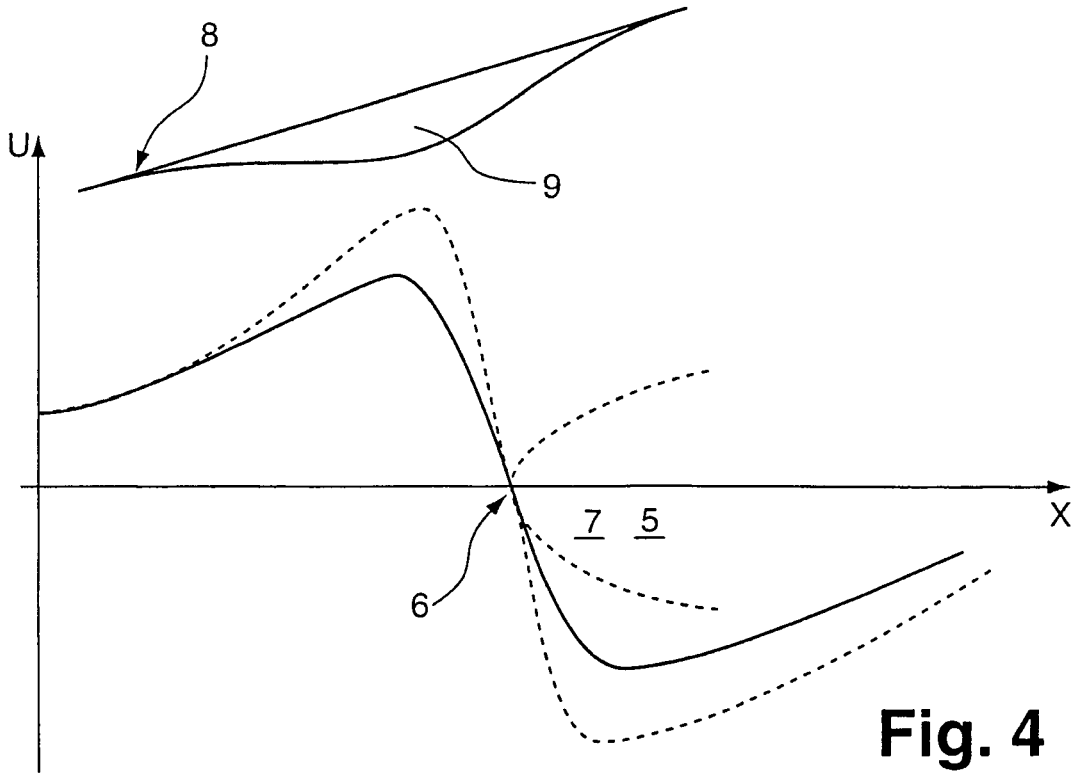
FIG. 4 shows a graphical illustration of the velocity gradients in the flow direction along an exemplary segment narrowing the flow cross section.

FIG. 4 illustrates a graph to make clear the axial velocity profile through the premixing burner or swirl generator. The x-axis corresponds to the burner axis and the y-axis is the flow velocity u, oriented in the axial flow direction, of the burner flow. In the case of a conventional burner arrangement, that is to say without the use of the contour 9, according to exemplary embodiments, the locally narrowing the flow cross section (see the unbroken line), the axial flow velocity within the premixing burner rises and is braked on account of the increasing flow instability, and a local flow reversal (see the position of the stagnation point 6) occurs at the burner outlet, not least due to the discontinuous cross-sectional widening, with the result that the backflow zone (5) already mentioned above is formed.

In order to stabilize the foremost stagnation point 6 of the backflow zone 5, that is to say cause it to be as unchanged as possible with respect to the x-axis, it was apparent that, by a local increase in the flow velocity and by a more marked velocity deceleration, a higher velocity gradient which can considerably improve the positional stability of the stagnation point 6 can be achieved at the location of the latter. This purpose is served by the contour 9 which is likewise illustrated diagrammatically via the graph and narrows the flow cross section and which, on account of the Bernoulli effect, leads first to an acceleration of the flow velocity in the x-direction and, after the overshooting of the region of the smallest flow cross section, to an efficient flow deceleration, with the result that the velocity profile experiences a higher gradient, particularly at the forward stagnation point 6 (see the dashed line). Owing to this local increase in the velocity gradient or else swirl gradient due to the convergent/divergent flow routing, the aerodynamic stability of the stagnation point 6 is increased, without appreciable burner pressure losses in this case having to be taken into account.

Figure 5:
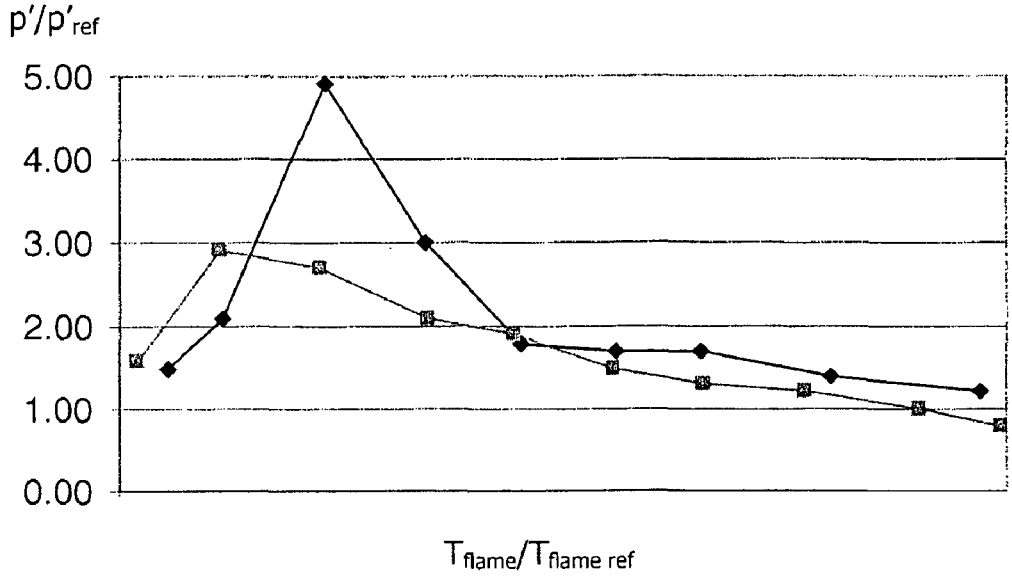
FIG. 5 shows a graph to illustrate exemplary pressure fluctuations at low temperatures.

The conduct of atmospheric combustion tests, in each case with two structurally identical burners with and without contouring, gives the result that premixing burners with the contouring, according to exemplary embodiments of the invention, have markedly lower pressure fluctuations than correspondingly conventionally designed premixing burners. FIG. 5 shows, in this respect, a graphical illustration, along the x-axis of which the flame temperature is indicated and along the y-axis of which the magnitude of pressure fluctuations is indicated in the standardized illustration. The line with the square markings corresponds to the operation of a premixing burner with the contouring according to an exemplary embodiment of the invention and the line having lozenges corresponds to a conventional premixing burner. It is shown very clearly that, above all at low flame temperatures, far lower pressure fluctuations can occur in a premixing burner designed according to an exemplary embodiment of the invention than in a conventional premixing burner.

Figure 6:
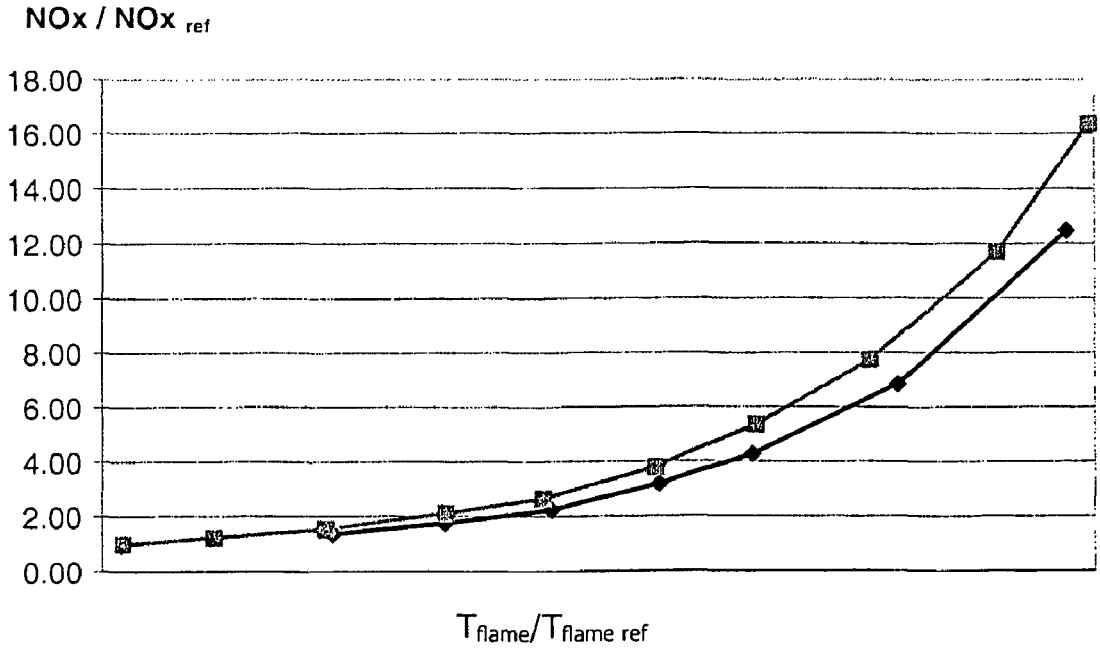
FIG. 6 shows a graphical illustration with exemplary emission values.

It is also shown that the measure according to an exemplary embodiment of the invention can have virtually no effects on an increased emission behavior in terms of nitrogen oxide. FIG. 6 illustrates a graph, along the x-axis of which the flame temperature is plotted and along the y-axis of which the nitrogen oxide concentration is plotted in a standardized illustration. Both the premixing burner with the contouring designed according to the invention (see, in this respect, the line with rectangles) and a conventional premixing burner (see, in this respect, the line with lozenges) run largely parallel at a low level.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| | |
|---|---|
| 1 | Premixing burner, swirl generator |
| 2 | Air inlet slit |
| 3 | Burner outlet |
| 4 | Combustion chamber |
| 5 | Backflow zone |
| 6 | Forward stagnation point or forward front of the backflow zone |
| 7 | Premixing flame, backflow bubble |
| 8 | Burner wall |

-continued

| | |
|---|---|
| 9 | Contour |
| 91, 92, 93 | Segments |
| 10 | Local axial region |
| 11, 12 | Part-conical shells |

increased ally in the flow direction.

What is claimed is:

1. A premixing burner for operating a combustion chamber by means of a liquid and/or gaseous fuel, comprising:

a swirl generator for a combustion inflow air stream for forming a swirl flow;

means for the injection of fuel into the swirl flow, the swirl generator being configured to be adjacent to the combustion chamber indirectly via a mixing zone or directly, in each case via a burner outlet;

a cross-sectional widening at the burner outlet which is discontinuous in the flow direction of the swirl flow and through which the swirl flow bursts open so as to form a backflow zone, the swirl generator having at least two part-conical shells which complete one another to form a body and which jointly enclose a conically designed swirl space with a cone angle 2γ and air inlet slits tangential in the cone longitudinal extent;

a mid-axis (M11, M12) assigned in each case to each part-conical shell, said mid-axes running separately from one another in spatial terms; and a contour locally narrowing a flow cross section of the swirl generator or of the mixing zone in the flow direction upstream of the burner outlet, which contour is arranged in a region of a foremost front of the backflow zone in the flow direction and has, in the flow direction, a first segment which continuously reduces the flow cross section, a second segment with a smallest flow cross section and a third segment adjoining the second segment in the flow direction and continuously increasing the flow cross section.

2. The premixing burner as claimed in claim 1, wherein the contour provided at the inner circumferential edge of the swirl generator or of the mixing zone.

3. The premixing burner as claimed in claim 2, wherein the contour encloses a flow duct which is designed in the manner of a Venturi tube.

4. The premixing burner as claimed in claim 3, wherein the third segment possesses, within the premixing burner, an axial position which lies in the region of that front of the forming backflow zone which is foremost in the flow direction.

5. The premixing burner as claimed in claim 4, wherein the swirl generator is configured to be directly adjacent to the combustion chamber via the burner outlet, and the contour locally narrowing the flow cross section of the swirl generator is described by geometric conditions as follows:

$$0.5 \leqq R1(x)RB(x) \leqq 1$$

$$0.5 \leqq R2(x)RB(x) \leqq 2 \text{ and}$$

$$\gamma < \alpha < 40°$$

with x: locus coordinate along a mid-axis of a part-conical shell

R1: radial distance between a mid-axis of a part-conical shell and a surface of the contour at a locus x along the mid-axis RB: radial distance between the mid-axis of a part-conical shell and the surface of the original part-conical shell at the locus x along the mid-axis R2: elevation of the contour, measured from the surface of the part-conical shell at the locus x along the mid-axis α: angle between a tangential surface of the contour and the mid-axis of the part-conical shell at the locus x along the mid-axis γ: cone half angle.

6. The premixing burner as claimed in claim 5, wherein the premixing burner is a double cone burner, and the smallest flow cross section is shaped elliptically in the region of the contour.

7. The premixing burner as claimed in claim 6, wherein the combustion chamber is followed by turbine stages of a gas turbine plant.

8. The premixing burner as claimed in claim 1, wherein the contour encloses a flow duct which is designed in the manner of a Venturi tube.

9. The premixing burner as claimed in claim 1, wherein the third segment possesses, within the premixing burner, an axial position which lies in the region of that front of the forming backflow zone which is foremost in the flow direction.

10. The premixing burner as claimed in claim 1, wherein the swirl generator is configured to be directly adjacent to the combustion chamber via the burner outlet, and the contour locally narrowing the flow cross section of the swirl generator is described by geometric conditions as follows:

$$0.5 \leqq R1(x)RB(x) \leqq 1$$

$$0.5 \leqq R2(x)RB(x) \leqq 2 \text{ and}$$

$$\gamma < \alpha < 40°$$

with x: locus coordinate along a mid-axis of a part-conical shell

R1: radial distance between a mid-axis of a part-conical shell and a surface of the contour at a locus x along the mid-axis RB: radial distance between the mid-axis of a part-conical shell and the surface of the original part-conical shell at the locus x along the mid-axis R2: elevation of the contour, measured from the surface of the part-conical shell at the locus x along the mid-axis α: angle between a tangential surface of the contour and the mid-axis of the part-conical shell at the locus x along the mid-axis γ: cone half angle.

11. The premixing burner as claimed in claim 1, wherein the premixing burner is a double cone burner, and the smallest flow cross section is shaped elliptically in the region of the contour.

12. The premixing burner as claimed in claim 1, wherein the combustion chamber is followed by turbine stages of a gas turbine plant.

13. A method for operating a combustion chamber, comprising:

operating a combustion chamber having a premixing chamber using a liquid and/or gaseous fuel;

forming a swirl flow with a swirl generator for a combustion inflow air stream;

injecting fuel into the swirl flow, the swirl generator being configured to be adjacent to the combustion chamber indirectly via a mixing zone or directly, in each case via a burner outlet;

forming a backflow zone using a cross-sectional widening at the burner outlet which is discontinuous in the flow direction of the swirl flow and through which the swirl flow bursts open, the swirl generator having at least two part-conical shells which complete one another to form a body and which jointly enclose a conically designed swirl space with a cone angle 2γ and air inlet slits tangential in the cone longitudinal extent, a mid-axis (M11, M12) being assigned in each case to each part-conical shell, said mid-axes running separately from one another in spatial terms; and a contour locally narrowing a flow cross section of the swirl generator or of the mixing zone in the flow direction upstream of the burner outlet, which contour is arranged in a region of a foremost front of the backflow zone in the flow direction and has, in the flow direction, a first segment which continuously reduces the flow cross section, a second segment with a smallest flow cross section and a third segment adjoining the second segment in the flow direction and continuously increasing the flow cross section; and locally accelerating and decelerating the swirl flow in the axial flow direction within the swirl generator or in a mixing zone adjoining the swirl generator.

14. The method as claimed in claim 13, wherein the axial acceleration of the swirl flow takes place upstream of the foremost front of the forming backflow zone, and deceleration takes place at least partially upstream of the foremost front of the forming backflow zone.

15. The method as claimed in claim 14, wherein the acceleration and deceleration take place, utilizing the Bernoulli effect.

16. The method as claimed in claim 13, wherein the acceleration and deceleration take place, utilizing the Bernoulli effect.

17. The method as claimed in claim 13, wherein the swirl gradient of the swirl flow is increased locally in the flow direction.

* * * * *